US005186614A

United States Patent [19]

Abousabha

[11] Patent Number: 5,186,614

[45] Date of Patent: Feb. 16, 1993

[54] VARIABLE DISCHARGE FLOW ATTENUATION FOR COMPRESSOR

[75] Inventor: Naji G. Abousabha, Youngstown, N.Y.

[73] Assignee: General Motors Corporation, Detroit, Mich.

[21] Appl. No.: 787,180

[22] Filed: Nov. 4, 1991

[51] Int. Cl.[5] ..... F04B 21/02

[52] U.S. Cl. ..... 417/312; 417/222.1; 181/403

[58] Field of Search ..... 417/222 S, 222 R, 312, 417/313; 181/403, 277, 278, 274

[56] References Cited

U.S. PATENT DOCUMENTS

| | | | |
|---|---|---|---|
| 994,028 | 5/1911 | Palmer | 181/277 |
| 1,927,947 | 9/1933 | Newell | 181/278 |
| 2,518,869 | 8/1950 | Corless | 181/277 |
| 3,323,614 | 6/1967 | Thrasher | 181/274 |
| 3,585,901 | 6/1971 | Moon | 417/312 |
| 3,864,064 | 2/1975 | Gannaway | 417/312 |
| 4,274,813 | 6/1981 | Kishi et al. | 417/269 |
| 4,330,239 | 5/1982 | Gannaway | 417/312 |
| 4,410,303 | 10/1983 | Bar | 417/312 |
| 4,652,217 | 3/1987 | Shibuya | 417/269 |
| 4,813,852 | 3/1989 | Ikeda et al. | 417/269 |
| 4,815,358 | 3/1989 | Smith | 417/269 |
| 5,112,198 | 5/1992 | Skinner | 417/312 |

*Primary Examiner*—John J. Vrablik
*Assistant Examiner*—Peter Korytnyk
*Attorney, Agent, or Firm*—Ronald L. Phillips

[57] ABSTRACT

A refrigerant compressor is disclosed having pistons that reciprocate in radially arrayed cylinder bores of a cylinder block. A discharge chamber is formed in the compressor. A valving means including a timing plate is positioned within the discharge chamber, and alternately covers and uncovers the compressor outlet port. The timing plate includes spaced variable flow orifices to thereby attenuate the pressure pulsations that occur during the operating cycle. The timing plate is a circular disc rotatably connected to the end of the compressor drive shaft. Each flow orifice is pear-shaped and positioned with a constant radial and circumferential spacing for synchronization with the cylinders.

6 Claims, 2 Drawing Sheets

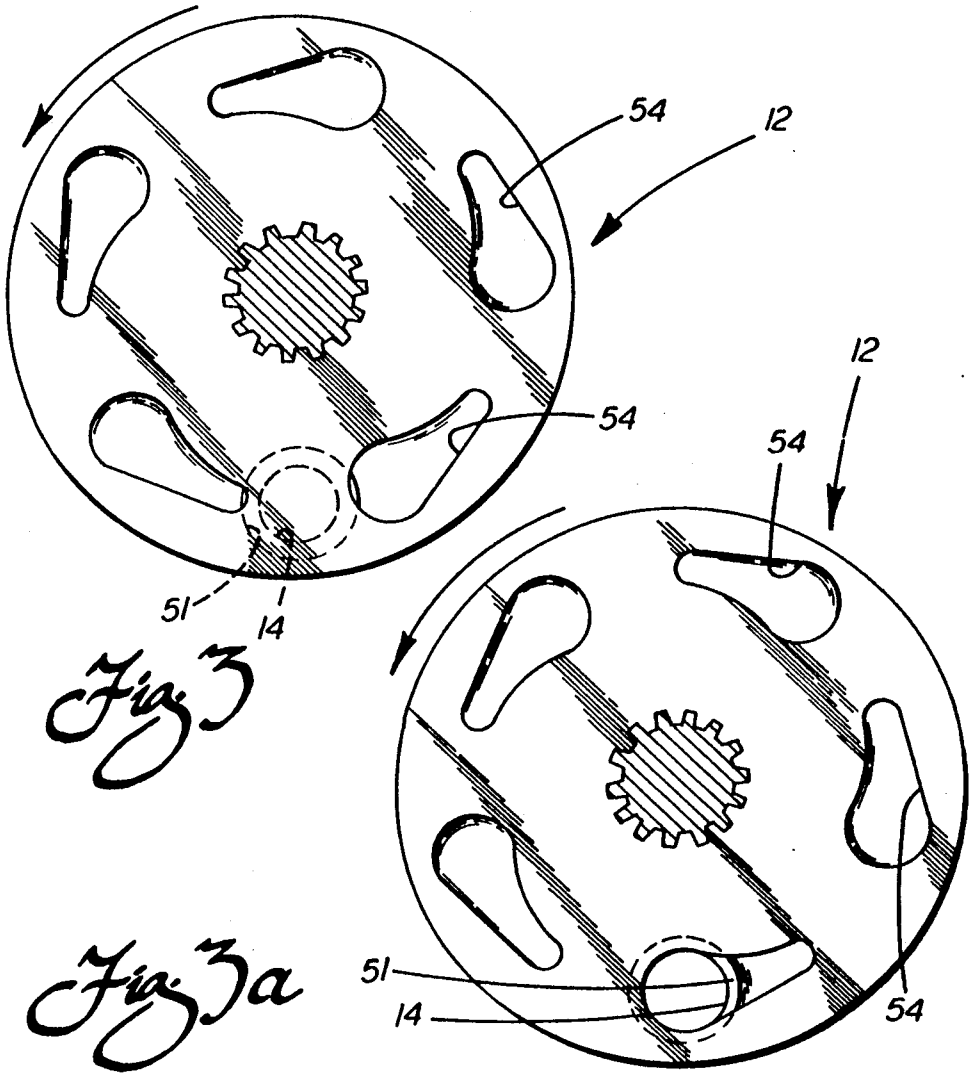
Fig. 3
Fig. 3a
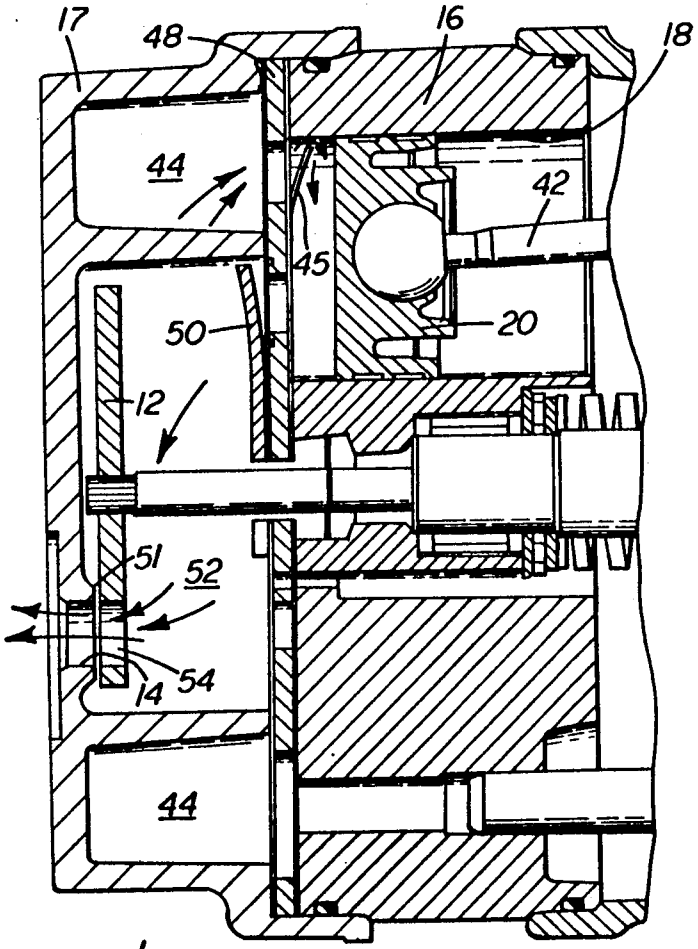
Fig. 2

VARIABLE DISCHARGE FLOW ATTENUATION FOR COMPRESSOR

TECHNICAL FIELD

The present invention relates to variable displacement axial compressors, and more particularly, to an assembly providing pressure pulse attenuation for pressurized discharge gas and the related method, resulting in smoother operation and extended service life of the compressor.

BACKGROUND OF THE INVENTION

A variety of refrigerant compressors for use in vehicle air conditioning systems are currently available. A popular vehicle compressor design is the variable displacement axial type. In this type of compressor, a number of cylinders are equally angularly spaced about and equally radially spaced from the axis of a central drive shaft. A piston is mounted for reciprocal sliding motion in each of the cylinders. Each piston is connected to a swash plate or wobble plate received about and operatively connected to the drive shaft. During operation of the compressor, rotation of the drive shaft imparts a wave-like reciprocating motion to the wobble plate. This driving of the wobble plate in a nutating path about the drive shaft serves to impart a linear reciprocating motion to the pistons. By varying the angle of the wobble plate relative to the drive shaft, the stoke of the pistons and, therefore, the displacement or capacity of the compressor may be varied to effect the desired compressing action.

A shortcoming realized in this type of compressor system is the degraded performance resulting from gas pressure pulsations discharged from the compressor. While the piston type compressor provides an effective way to compress and circulate the refrigerant fluid throughout the system, it has the adverse side effect of delivering high pressure pulsations coincident with the discharge stroke of the pistons. In addition to creating a noisier and rougher operating system, these discharge pressure pulsations also lead to premature fatigue and failure of component parts throughout the air conditioning system, thereby diminishing its reliability.

Various attempts have been made to reduce these pressure pulsations in order to provide smoother and quieter running systems. One accepted approach is to provide a restriction, such as a restricted nozzle, in the discharge port of the compressor. As another example, U.S. Pat. No. 4,652,217, issued Mar. 24, 1987, to Shibuya shows a compressor with an attenuation device in the form of a porous plug in the valve plate (see FIGS. 4 & 5). This attenuation device operates in the same manner as a standard restricted orifice by limiting the rate that gas is permitted to escape the discharge chamber. This discharge rate is regulated by the size and number of the restriction holes provided in the porous plug. The system is configured such that, during the piston discharge stroke, a much greater volume of fluid is discharged from the cylinder bore into an intermediate discharge cavity than the restriction holes allow to pass through the valve plate to the final discharge chamber. This results in a variable pressurized region within the intermediate discharge cavity. This pressure buildup is evidenced during the piston intake stroke by a continual, and thus somewhat smoothed flow of pressurized gas to, and consequently from the discharge chamber to the outlet port. In this way, the net effect of the restriction is to stretch the compressor discharge over the entire operational cycle (both intake and discharge strokes), rather than just during the discharge stroke. The restriction also provides some attenuation by interaction of the established stream pulsations with incident pressure waves adjacent the restriction. This action works by cancellation of opposing fluid forces, as is well known.

A different type of attenuation assembly is shown in U.S. Pat. No. 4,274,813 to Kishi et al., issued Jun. 23, 1981, in which a plurality of baffles or dividers are provided in cascade fashion within the discharge chamber. These baffles have a similar effect on the pressure pulsations resulting from the discharge stroke of the piston, as did the restriction holes in the Shibuya patent. That is, they provide a restriction so as to prevent the fluid pulses from freely propagating through the discharge chamber to the outlet port of the compressor. The result is a similar buildup of pressure within the discharge chamber during the piston discharge stroke. The increased pressure, like in the Shibuya patent, is bled away during the piston intake stroke, thereby spreading the discharge over the entire operational cycle. Also, to some extent the pulsations and incident pressure waves cancel each other out, as in the other arrangements.

While these design approaches have realized performance and reliability improvements over other attempts, they enjoy only limited success. One reason for this limitation is due to the constant or static orifice area provided for the fluid discharge by the restriction hole(s) or baffles.

More specifically, and as elementary laws of fluid dynamics confirm, the volumetric rate at which fluid is transferred in a compressor from the discharge chamber through the outlet port and into the outgoing refrigerant line is directly proportional to the pressure differential between the discharge chamber and the refrigerant line, as well as the size of the orifice area connecting the two. Therefore, in order to maintain a substantially constant pressure at the output port and within the refrigerant line, and thus maximize attenuation of pulses, the area of the connecting orifice should be variable and controlled according to the changing pressure within the discharge chamber. It is readily observed that any design approach providing only a static or constant area orifice still exhibits notable pressure pulsations at the output. Accordingly, a need clearly exists for a design with a variable orifice to further reduce the gas pressure pulsations from a compressor.

SUMMARY OF THE INVENTION

It is accordingly a primary object of the present invention to provide an assembly for a fluid compressor and related method utilizing a variable flow orifice that more efficiently attenuates pressure pulsations for smoother and quieter operation.

Another object is to provide an improved pressure pulsation attenuation assembly in an automotive air conditioning compressor and method that provides a variable orifice under active control to smooth the flow from the discharge port of the compressor.

Still another object of the present invention is to provide a pressure pulsation attenuation assembly in an automotive air conditioning compressor having an active control valve to provide a variable flow and increased pulsation attenuation or dampening over that of the former static attenuators described above.

Yet another object of the present invention is to provide an improved pressure pulsation attenuation assembly in an automotive refrigerant compressor including an active control valve comprising a timing plate with specially shape orifice located in the discharge chamber and working in conjunction with the outlet port, thus resulting in pulsation attenuation and in smoother and quieter operation.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved pressure pulsation attenuation assembly is provided for a compressor utilizing a variable orifice to regulate the flow. The attenuation assembly is particularly useful to attenuate or dampen pulses resulting from the operation of a piston type compressor. In its broadest aspects, the present invention relates to a system for active control of the flow from the compressor outlet port. In response to pressure pulses or changes within the discharge chamber, the variable orifice is varied or adjusted from partially restricted to wide open to thereby smooth the flow.

More particularly, the pressure within the discharge chamber normally fluctuates during a single operational cycle in a predictable and periodic fashion, such that it is at a maximum at the completion of each discharge stroke and a minimum during the intake stroke. Utilizing this knowledge to achieve maximum pressure pulsation attenuation, an active valving means is provided that variably controls and regulates the flow to the outlet port in proper timing and synchronization with each operational cycle of the compressor.

In the preferred embodiment, the valving means includes a timing plate or rotatable disc centrally attached to the compressor drive shaft, whereby rotation of the drive shaft is imparted to the timing plate. In this way, rotation of the timing plate is synchronized with each reciprocating piston in the cylinder bores. That is, since all of the pistons of the compressor cycle through one complete discharge stroke and one complete intake stroke for each revolution of the drive shaft, and assuming proper orientation of the timing plate on the drive shaft, the timing plates movement is synchronized with the pistons.

The plate is characterized by a plurality of flow orifices that are angularly spaced about a constant radius from the central longitudinal axis. The angular spacing corresponds to the spacing between the operating cylinders. The radius is determined such that the flow orifices line up or coincide with the outlet port.

The timing plate is spaced by a predetermined gap from the lip of the outlet port. During each compression stroke when the maximum flow of pressurized fluid is coming from one of the cylinder bores, the plate thus partially covers and restricts the flow to the outlet port.

When the flow from the cylinders is reduced, the corresponding flow orifice aligns with the outlet port. Each flow orifice provides increasing flow generally tracking the decreasing pressure in the discharge chamber, as will be evident from the discussion below. To put it another way, rotation of the timing plate during compressor operation effectively serves to variably cover and uncover the outlet port spreading the flow over the full cycle and thus offsetting the pressure fluctuations.

The valving means is tuned by selecting the proper length of the solid portion and the length of overlap between the outlet port and the flow orifices of the timing plate. In its broadest aspects, the outlet port and the timing plate flow orifices may be the same size and shape.

More particularly, assume that initially a solid portion of the timing plate coincides with the outlet port, such that the outlet port is completely covered except for the gap between plate and the lip of the port. The pressurized gas flow is restricted to a flow ring around the port. As the orifice of the timing plate rotates into alignment with the outlet port, the discharge of the gas is increased. The flow-through area incrementally increases in size until the plate rotates into such a position that precise alignment between the orifice and the outlet port occurs. At this point, the flow-through area to the port is at a maximum. Accordingly, as the timing plate continues to rotate and the orifice rotates out of alignment with the outlet port, the corresponding flow-through area is incrementally decreased until the outlet port is again covered.

As previously discussed, pressure pulsations of the pressurized output fluid at the outlet port are substantially eliminated if a substantially constant volumetric fluid discharge rate therefrom is maintained. In operation and in accordance with the related method of the invention, this is accomplished by the outlet port being covered during the compression stroke of the piston in the cylinder bore, and more particularly, covered when the discharge reed valve of the discharge port of the cylinder is open. The pressure pulsation is thus attenuated and a baseline flow rate established as the gas forces its way into the outlet port via the flow ring around the outlet port. Once this initial pressure pulse is attenuated, the discharge flow rate is maintained by the flow orifice being gradually uncovered in proportion to the decreasing residual pressure in the discharge chamber. When the timing plate again covers the outlet port, the discharge reed valve on the next in-line cylinder is set to open, and the operational cycle repeats itself.

It should be further appreciated that in accordance with the more limited principles of the invention, an infinite number of variations between the size and shape of the discharge port and the timing plate orifices can be implemented to achieve desirable results. However, in the present preferred embodiment, and for both economic efficiency of this disclosure and better retrofitability to existing compressors, the round shape of the outlet port is left unchanged. This provides for adaptation of the present invention to a variety of different model compressors at minimal cost.

Also, in the preferred embodiment, the present invention utilizes generally pear-shaped orifices in the timing plate. Each orifice is oriented such that, as the plate rotates, the narrow end of the orifice leads into the alignment or overlap with the outlet port. Accordingly, the wide end is the last to overlap with the outlet port. The net effect of this arrangement is to provide a relatively small direct flow-through orifice area immediately after the discharge reed valve closes and during the early portion of the intake stroke (while discharge cavity pressure is still relatively high). The flow-through orifice area continues to increase the effective discharge area as the intake stroke progresses (progressively lower discharge chamber pressurization). This in effect gives a smooth, generally even flow from each cylinder, which when mixed with the residual flow from the other cylinders in the discharge chamber, eliminates the undesirable spiking of pressures and smooths the flow.

In addition to the improved results due to this flow control, the advantageous pulsation/incident pressure wave interaction is also improved. Especially during maximum pressure pulsation when the discharge reed valve is open, the interacting solid portion of timing plate and the lip of the outlet port, provide increased reflected pressure waves as the flow reverses and flows behind the plate to exit as the flow ring. The cancelling effect of the established flow stream and these pressure waves of opposite and angular vectors is thus more effective, and as indicated above is spread out over a longer time period. Also the rotation of the timing plate sets up turbulent boundary layer flow providing additional flow vectors to intercept and attenuate the primary pulses of gas from the cylinders.

This active and controlled attenuation of the pressure pulsations at the outlet port of the compressor, provides for a smoother and quieter running compressor. Since unchecked pressure pulsations induce secondary vibrations in the air conditioning system and the vehicle itself, a reduction in the pulsations in the compressor accordingly smooths the entire vehicle operation. Therefore, component fatigue and failure in the air conditioning system resulting from such vibrations are reduced, thereby increasing the useful life of the system. Additionally, the smoother and quieter running system and vehicle, certainly provides increased customer satisfaction.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 2 is a cross sectional side view, like FIG. 1, showing the timing plate in a position such that the variable flow orifice and the outlet port are aligned and fully open; and FIG. 3 and 3*a* are front views of the timing plate showing the shape of the flow orifices and positioning relative to the outlet port corresponding to FIGS. 1 and 2, respectively.

Figure 1:
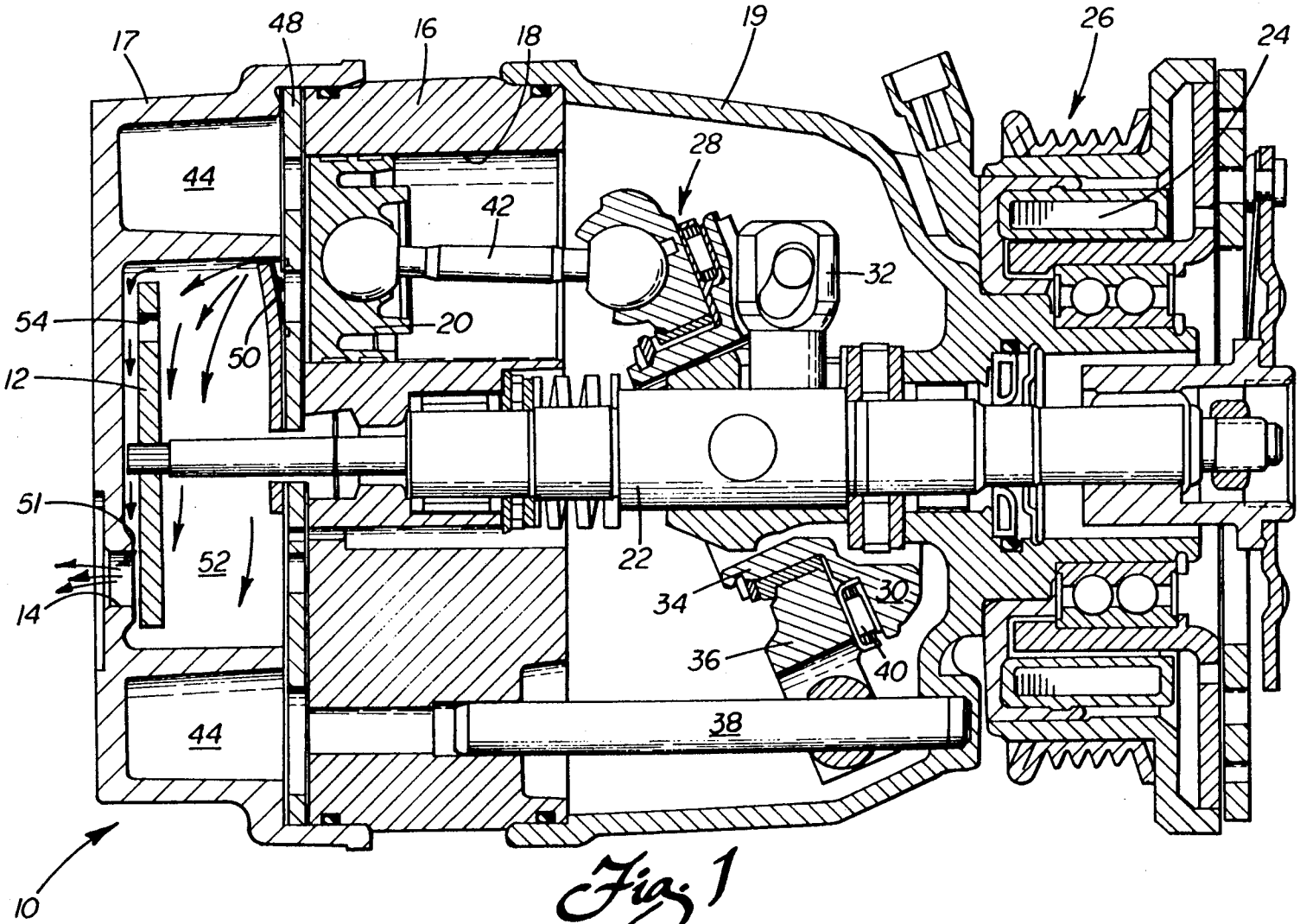
FIG. 1 is a cross sectional side view of the entire compressor showing the location of the active valving means, and with the orientation of the timing plate relative to the outlet port during the time period when the discharge reed valve is open, such that the outlet port is partially covered by the solid portion of the plate.

Reference will now be made in detail to the present preferred embodiment of the invention, an example of which is illustrated in the accompanying drawing.

DETAILED DESCRIPTION OF THE PREFERRED EMBODIMENT

Reference is now made to FIG. 1 illustrating a cross section of a variable displacement wobble plate compressor 10 including an attenuation assembly constructed in accordance with the teachings of the present invention. As should be appreciated from a review of the following description, the attenuation assembly of the present invention greatly improves the performance and reliability of the compressor 10 by attenuating the gas pressure pulsations at discharge outlet port 14.

As is known in the art and shown, for example, in U.S. Pat. No. 4,815,358 to Smith, issued Mar. 28, 1989 (assigned to the assignee of the present invention), the variable angle wobble plate compressor 10 is formed primarily by the combination of a cylinder block 16, a compressor head 17 and a crankcase 19. The cylinder block 16 includes five axially aligned cylinder bores 18 (only one is shown in FIG. 1). A piston 20 is slidingly engaged for reciprocal motion within each of the cylinder bores 18. The reciprocating action of the piston 20 is utilized to compress and circulate refrigerant fluid throughout the air conditioning system. The compressed refrigerant gas is discharged from the outlet port 14 of the compressor 10 where it is utilized by the air conditioning system to condition air being directed to the vehicle interior. The "spent" or low pressure refrigerant gas is then returned to the compressor 10 through an inlet port (not shown) to complete the cycle.

A central drive shaft 22 is axially aligned within the cylinder block 18 and crankcase 19. The drive shaft 22 extends externally from the crank case 19 and is attached through an electromagnetic clutch 24 to a pulley 26. A fan belt (not shown) is attached to the pulley 26 and to the vehicle engine (not shown). During engine operation, the fan belt transmits power from the engine to the pulley 26 and the drive shaft 22 to the compressor 10. A journal plate assembly 28 is provided for reciprocating the pistons 20. The journal plate assembly 28 includes a rotary driving plate 30 that is attached to a driving lug 32 connected to the drive shaft 22. In this way, the driving plate 30 is rotated with the drive shaft 22.

The driving plate 30 includes a journal 34 on which a non-rotary wobble plate 36 is mounted. The wobble plate 36 is prevented from rotating by its connection to a stationary guide rod 38. More specifically, the non-rotary wobble plate 36 is mounted at its inner diameter on the journal 34 and is axially retained thereon against a needle bearing 40. A more in-depth understanding of this configuration is disclosed in U.S. patent to Smith U.S. Pat. No. 4,815,358, mentioned above.

As the drive shaft 22 rotates, the driving plate 30 is rotated therewith, through its connection with the drive lug 32. This in turn imparts a nutating motion to the non-rotary wobble plate 36. The precise path of the wobble plate 36 is determined by the angle of the journal plate assembly 28 to the drive shaft 22. More particularly, when the journal plate assembly 28 is positioned at a maximum angle as shown in FIG. 1, the nutating motion is at a maximum. Thus, through the connection of the pistons 20 to the wobble plate 36 by means of the piston rod 42, it should be appreciated that the pistons are then reciprocated through their full stroke. Accordingly, the compressor 10 operates at maximum capacity. Conversely, when the journal plate assembly 28 is adjusted so as to be perpendicular to the drive shaft 22, the driving plate 30 spins freely without imparting motion to either the wobble plate 36 or the pistons 20. The operation of the compressor 10 is effectively terminated in this position. Of course, by varying the angle of the journal plate assembly 28 anywhere between these two extremes, an infinite number of intermediate capacity levels may be achieved by the compressor 10.

Refrigerant gas is introduced into the compressor 10 through an inlet port (not shown) and delivered into an annular suction cavity 44 located within the compressor head 17. Inlet reed valves 45 (FIG. 2) are provided for each cylinder 18 on valve plate 48. During the piston intake stroke, sufficient suction force is generated by the piston 20 to open each valve 45 in sequence and draw refrigerant fluid from the suction cavity 44 into the corresponding cylinder bore 18. During the discharge stroke, the refrigerant gas is compressed within the cylinder bore 18 causing a discharge reed valve 50 to snap open (see FIG. 1), whereby the high pressure refrigerant gas is expulsed from the cylinder bore 18 into discharge chamber 52. The inlet and discharge reed valves 45, 50 provide for unidirectional fluid flow through the compressor 10, and ultimately assure proper fluid circulation throughout the air conditioning system.

In typical compressor systems, fluid is freely discharged from the discharge chamber 52 through the outlet port 14. As discussed previously, this results in pressure pulsations evidenced throughout the system coinciding with the discharge stroke of the pistons 20. The present invention provides an assembly in the form of a valving means that regulates the volumetric output of the refrigerant fluid from the outlet port 14, thereby greatly attenuating these pressure pulsations.

A key component of the valving means is a timing plate 12 mounted for rotary movement in the compressor discharge chamber 52. The timing plate 12 is circular and centrally attached to the end of the drive shaft 22, whereby rotation of the drive shaft imparts the desired synchronized rotation. The timing plate 12 is placed in proximate location to the end wall of the compressor head 17, such that only a small gap or clearance is provided. The significance of this clearance is discussed in more detail below.

As shown in FIG. 3, the timing plate 12 includes a plurality of flow orifices 54. The orifices 54 are uniformly spaced about a constant annular radius from the central axis of the timing plate 12. The flow orifices 54 are preferably pearshaped and oriented such that a narrow end of the flow orifice 54 leads a wide end as the timing plate 12 rotates. This variable shape, in combination with the rotation of the timing plate 12, serves to effectively vary the flow-through area of the valving means to the outlet port 14, so as to minimize discharge pressure pulsations therefrom. The radius, or distance of the orifices 54 from the central axis of the timing plate 12, is provided such that the orifices 54 align with the outlet port 14 during rotation of the timing plate 12.

The timing plate 12 rotates such that each orifice 54 periodically aligns with the compressor outlet port 14. As the narrow end of each orifice 54 comes into alignment with the outlet port 14, there is a gradual opening of the flow-through area. As the pressure is lowered, the flow-through area progressively increases. As previously discussed, by providing only a small exit opening when the pressure within the discharge chamber is high and a gradually larger opening when the pressure within the discharge chamber 52 is being decreased, an essentially constant volumetric rate of fluid can be discharged from the discharge chamber 52.

To review the entire sequence, FIG. 1 shows the operation of the present invention at a point in time when the piston 20 is in a discharge stroke. The discharge reed valve 50 is open as the refrigerant gas is discharged from the cylinder bore 18 into the discharge chamber 52. At this point of high discharge pressure, a solid portion or face of the timing plate 12 is coincident with the outlet port 14. Only restricted flow through the flow ring around the gap between lip 51 of outlet port 14 and the plate is possible. It should be appreciated from the above discussion that a narrow end of one of the flow orifices 54 is about to rotate into alignment with the outlet port 14. When this does happen, compressed refrigerant gas within the discharge chamber 52 then begins discharging through the uncovered small opening, as well as continuing around the flow ring.

FIG. 2 shows the operation of the compressor 10 at a point in the cycle when the pressure in the chamber 52 is dissipated and is now relatively low. At this time, the piston 20, illustrated in the drawings, happens to be on the intake stroke. The discharge reed valve 50 is closed, preventing gas from escaping from the discharge chamber 52 back into the cylinder bore 18. The flow orifice 54 completes the movement across the outlet port 14 so that it is in a position with the wide end aligned over said port 14, thereby providing the maximum flow-through area. It should be appreciated that, by this point in the cycle, the pressure within the discharge chamber 52 is sufficiently diminished such that the increased flow area effectively serves to offset the decreased chamber pressure. In effect, this continues to provide an essentially constant volumetric fluid discharge from the outlet port 14. The result is a corresponding constant depressurization and elimination of pressure spiking in the chamber 52, and thus within the refrigerant line outside the compressor 10.

The gap between the lip 51 and the timing plate 12 is important. First, the gap is necessary so that, at the times when a solid portion of the timing plate 12 covers, or is aligned with the outlet port 14, fluid continues to discharge in a controlled manner. Otherwise, the pressure in the chamber 52 and the outside refrigerant line attached to the port 14 would build up. Indeed, the pulsing effect would be exaggerated unless flow through this limited, restricted gap forming the flow ring can thus be maintained.

Secondly, the closely spaced lip 51/timing plate 12 configuration also enhances the pulsation cancellation effects. This is effective over the full range of pressures and helps dissipate the staggered discharge pulses coming from the different cylinder bores 18. More particularly, pressurized refrigerant gas enters the discharge chamber in a directionalized fashion as it is discharged from the cylinder bores 18. Each pulsation is initially partially diminished by interception at an angle of incidence with the out of phase pulsations from the other cylinder bores 18. Especially during the time when a solid portion of the timing plate 12 aligns and covers the outlet port 14, the pulsations are further reduced by being reflected back and forth between the timing plate 12 and the back wall of the compressor head 17. The plate 12 is also constantly rotating, so that the boundary layer effect causes additional multidirectional flow vectors to help intercept and cancel the pulsing flow. Finally the high energy flow ring generates additional opposite and angular vectors, thereby further attenuating the pulsations.

Advantageously, the relative lengths of the orifice 54 and adjacent solid portion of the disc 12, as well as the relative size and shape of the orifice 54 and the outlet port 14, can be varied to effectively tune the attenuation assembly of the compressor 10. This helps achieve maximum pulsation attenuation.

As previously described, the flow orifice 54 first begins to align with the outlet port 14 after the piston 20 completes its discharge stroke. Likewise, the increasingly larger area of the orifice 54 is aligned with the outlet port 14 as the pressure subsides in the chamber 52. So that the pulse from each cylinder 18 is fully attenuated, in the preferred embodiment, the number of orifices 54 provided in the timing plate 12 is equal to the number of the cylinders 18.

Consistent with the concepts and teachings of the present invention, it should be appreciated that an alternate embodiment of the attenuation assembly may employ a timing plate advancing and retarding mechanism. That is, it may be desirable to incorporate a mechanism to actively advance or retard the orientation of the timing plate 12 depending upon the variable speed of the compressor 10 a driven through the clutch 24. This would effectively further assure proper positioning of the timing plate 12 to thereby provide improved pulsation attenuation.

In summary, various benefits and advantages are realized by the pressure pulsation attenuation assembly of the present invention. Among these advantages are smoother and quieter system operation and enhanced compressor 10 reliability. These benefits combine to result in a vehicle providing improved quality, performance and, correspondingly, increased customer satisfaction.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. In a refrigerant compressor of the type having a piston operating in a cylinder bore of a stationary cylinder block and including a separate chamber for fluid discharged from said cylinder bore, an assembly is provided for attenuating discharge pressure pulsations comprising:

a compressor outlet port located within said discharge chamber; and valving means for actively regulating the fluid flow to said outlet port and from said chamber, said valving means comprising a moveable plate having a solid portion and a flow orifice and being variable and operating to restrict fluid flow from said port during periods of relatively high pressure in said chamber and progressively increase fluid flow during periods of relatively low pressure;

whereby a substantially constant volumetric rate of fluid is discharged from said outlet port and pressure pulsations at said outlet port are attenuated.

2. In a refrigerant compressor of the type having a piston operating in a cylinder bore of a stationary cylinder block and including a separate chamber for fluid discharge from said cylinder bore, an assembly is provided for attentuating discharge pressure pulsations comprising:

a compressor outlet port located within said discharge chamber; and valving means for actively regulating the fluid flow to said outlet port and from said chamber, said valving means comprising a moveable plate having a solid portion and a flow orifice, driving means for said plate providing synchronized timing with said piston so as to present said solid portion to substantially cover said outlet port to restrict fluid flow from said port during periods of relatively high pressure in said chamber and to align with said flow orifice to progressively increase fluid flow during periods of relatively low pressure;

whereby a substantially constant volumetric rate of fluid is discharged from said outlet port and pressure pulsations at said outlet port are attenuated.

3. The assembly of claim 2, wherein said solid portion of said plate is positioned on said plate to substantially cover said outlet port to restrict flow during initial discharge of fluid from said bore and during the relatively high pressure period, said orifice being pear-shaped so a to allow progressively increased communication between said orifice and said outlet port so as to progressively increase fluid flow during periods of relatively low pressure.

4. The assembly of claim 3, wherein said plate is proximately spaced from the lip of said outlet port thereby forming a gap to establish a flow ring for restricted discharge of fluid when said solid portion substantially over said port and during the relatively high pressure period.

5. A method of actively attenuating discharge pressure pulsations of discharged refrigerant fluid from a refrigerant compressor of the type having a piston operating in a cylinder bore of a stationary cylinder block, to compress refrigerant and direct said refrigerant into a separate chamber with an outlet port, comprising the steps of:

providing a plate with an orifice for rotation within said chamber; and moving said plate inside said chamber to alternately cover and uncover said outlet port to regulate fluid flow to said outlet port and from said chamber, whereby a substantially constant volumetric rate of fluid is discharged from said outlet port and pressure pulsations at said outlet port are attenuated.

6. The method of claim 5, wherein said step of moving comprises:

rotating said plate to present a solid portion to substantially cover said outlet port during initial discharge of fluid from said bore and during the relatively high pressure period;

continuing to rotate said plate so as to align a first narrow end of said orifice for communication with said port; and continuing to rotate said plate to progressively align a relatively wide end of said orifice for communication with said outlet port to provide the progressive increase in fluid flow as the chamber pressure decreases.

* * * * *